United States Patent [19]

Liebich

[11] Patent Number: 4,851,625

[45] Date of Patent: Jul. 25, 1989

[54] SLIDING SWITCH

[75] Inventor: Ernst Liebich, Geltendorf, Fed. Rep. of Germany

[73] Assignee: Siemens Aktiengesellschaft, Berlin and Munich, Fed. Rep. of Germany

[21] Appl. No.: 253,420

[22] Filed: Oct. 4, 1988

Related U.S. Application Data

[63] Continuation of Ser. No. 595,393, Mar. 30, 1984.

[30] Foreign Application Priority Data

Jul. 12, 1983 [DE] Fed. Rep. of Germany ... 8320066[U]

[51] Int. Cl.[4] ..... H01H 15/04

[52] U.S. Cl. ..... 200/511; 200/6 B; 200/302.1

[58] Field of Search ..... 200/551, 547, 548, 302.1, 200/320, 325, 327, 324, 16 AC, 6 B

[56] References Cited

U.S. PATENT DOCUMENTS

| | | | |
|---|---|---|---|
| 3,770,921 | 11/1973 | Wilbrecht | 200/68.1 |
| 4,311,884 | 1/1982 | Henley et al. | 200/302.1 |
| 4,324,956 | 4/1982 | Sakakino et al. | 200/16 R |
| 4,395,609 | 7/1983 | Sowash | 200/551 X |
| 4,440,991 | 4/1984 | Sorenson | 200/302.1 |
| 4,454,391 | 6/1984 | Olsson | 200/291 |

FOREIGN PATENT DOCUMENTS

| | | | |
|---|---|---|---|
| 1108438 | 1/1956 | France | 200/68.1 |

*Primary Examiner*—Renee S. Luebke

*Attorney, Agent, or Firm*—Hill, Van Santen, Steadman & Simpson

[57] ABSTRACT

A sliding switch, for example a microswitch, comprises a membrane between an actuating member and a contact chamber, an intermediate sheet provided between the membrane and the actuating member has three tongues of which a middle tongue simultaneously acts on the first two ends of two double-arm contact bridges disposed parallel to one another, so that a double transfer with a close contact chamber is realized.

6 Claims, 2 Drawing Sheets

SLIDING SWITCH

This is a continuation, of application Ser. No. 595,393, filed Mar. 30, 1984.

BACKGROUND OF THE INVENTION

1. Field of the Invention

The present invention relates to a switch comprising an elastically-deformable membrane provided in a housing as a partition between a contact chamber and an actuation chamber, an actuating member disposed in the actuation chamber movable parallel to the membrane, an intermediate sheet provided between the actuating member and the membrane and having at least one tongue cut free from the intermediate sheet and supportable against the actuating member, on the one hand, and against the membrane, on the other hand, and comprising at least one contact bridge disposed in the contact chamber and actuable by the actuating member via the tongue.

2. Description of the Prior Art

Such a switch is known, in general, for example from the U.S. Letters Pat. 4,324,956. Given such a switch, the membrane closes the housing portion that contains the movable and fixed contacts of the switch so that such contacts are well-protected against environmental influences.

As a consequence of utilizing the membrane, however, the actuating member cannot directly influence the movable contacts of the switch. There is therefore an intermediate sheet provided between the actuating member and the membrane, which converts the motion of the actuating element, directed parallel to the membrane, into a motion directed at right angles relative to the membrane surface. The elastically-deformable membrane is thereby reversibly dented and, for example, a contact bridge that is disposed in the contact chamber of the switch housing is actuated.

The only technique known from the aforementioned U.S. Letters Pat. 4,324,956, however, is to realize a membrane sliding switch wherein two fixed contacts can be connected to one another through the membrane with the assistance of an actuating member. Given an unactuated switch, the connection between the fixed contacts of the switch is interrupted.

SUMMARY OF THE INVENTION

In comparison thereto, the object of the present invention is to provide a switch of the type generally set forth above such that a transfer switch is created in an uncomplicated and simple manner, i.e. a switch wherein a first fixed contact can be selectively connected to a second or third fixed contact.

The above object is achieved, according to the present invention, in that three tongues assigned to a single actuating member are cut free from the intermediate sheet, whereof two outer tongues are disposed parallel to one another and with their free ends opposed to the free end of a center tongue; in that two groups of respectively three oblong members extending at right angles relative to the moving direction of the actuating member and parallel to the membrane are provided next to one another in the contact chamber as fixed contacts; and in that a balance beam-like contact bridge employing the center fixed contact as a pivot bearing is respectively disposed between each contact group and the membrane and the center tongue has a width suitable for acting on both contact bridges.

A membrane sliding switch wherein two contact bridges are always actuated simultaneously when the actuating member is moved is therefore advantageously provided utilizing only one actuating member. As a result of this advantageous design of the actuating tongues of the intermediate sheet, it is thereby provided that the actuation of the two contact bridges, which occurs in the one direction due to the two outer tongues, is undertaken in common by a single tongue in the other direction.

It is provided according to a further feature of the invention that a housing wall lying opposite the membrane at the actuation chamber side is provided with two wall portions that are cut free, reside opposite one another with their free ends and extend parallel to the moving direction of the actuating member; that each wall portion comprises one hump at its free end and the actuating member comprises two humps which interact with the humps of the wall portions to form releasable lock in positions of the actuating member.

The fact is thereby advantageously exploited that the actuating member is largely symmetrically pressed against a housing wall lying opposite the membrane as a result of the tops of the intermediate sheet which is provided in opposition thereto, so that relatively simply-designed releasable lock in elements for fixing the position of the releasable lock in positions of the actuating member can be designed at the housing wall, whereby the tongues and that side of the actuating member facing the tongues can be optimally designed for the switch action of the actuating member and need not additionally be employed for the formation of releasable lock-in niches or releasable lock-in projections.

It can be further provided within the scope of the invention that the two humps of the actuating member in a middle position of the actuating member with limiting faces facing away from one another can be positioned between mutually-facing limiting faces of the wall portion humps.

A reliable releasable lock-in of the actuating member in that position in which the two contact bridges are lifted off from the two outer fixed contacts is thereby enabled in a particularly simple manner.

It can thereby be advantageously provided that the free ends of the wall portions limit therebetween a passage for a handle of the actuating member that projects out of the housing, a particularly simple design of the housing wall lying opposite the membrane at the actuating member side thereby occurring.

It can also be provided within the scope of the invention that the actuating member comprises an actuating rib extending parallel to the moving direction of the actuating member, comprising the actuating rib for each tongue at its side facing the membrane; that the ribs provided with an approach incline and ending about in the middle of the actuating member protrude from a wall of the actuating member that is parallel to the membrane; that the tongues are bent approximately S-shaped and the S-bend adjacent to the free ends of the tongues is supported against the membrane and the other S-bend is supported against either that wall of the actuating member parallel to the membrane or an actuating rib; and that the contact bridge is respectively provided with an offset bend in the region of the contact location between an S-bend and a membrane, the offset bend being directed against the membrane and being provided between a middle contact and an outer fixed contact.

A particularly efficient cooperation between the actuating member and the tongues of the intermediate sheet occurs as a result thereof, exploiting the possibility instituted by the structural design of the switch by optimally designing the tongues and the tongue-side of the actuating member only for the actuation of the contact bridge, since the releasable lock-in of the actuating member occurs elsewhere.

It can also be provided within the scope of the invention that the middle, fixed contact of each contact group is at a shorter distance from the membrane than the two other fixed contacts of each contact group.

A particularly operationally-reliable position of the contact bridges occurs as a result thereof, since an adequate distance between the free ends of the contact bridges and the outer fixed contacts is provided in simple manner, the free distance also preventing undesired contacting from occurring between a contact bridge and an outer fixed contact, even in switches that are exposed to vibrations or jolts.

Finally, it can also be provided within the scope of the invention that the fixed contacts comprise angled sections of wire pieces bent L-shaped whose respectively other angled sections project from the housing as switch terminal elements.

The above structure enables a particularly simple and uncomplicated manufacture of the fixed contacts since, without further complication steps, these can comprise the wire of the terminal elements projecting out of the housing of the switch.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
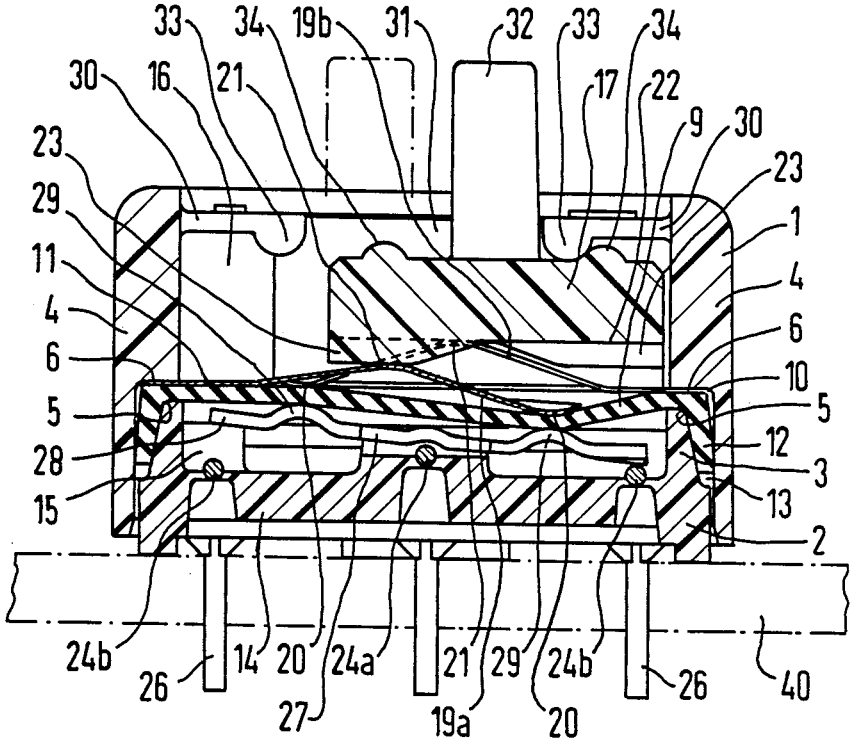
FIG. 1 is a longitudinal sectional view of a switch constructed in accordance with the present invention.

It can be derived in detail from the drawings that the switch housing is composed of an upper housing portion 1 and a lower housing portion 2 which both comprise plastic material.

The two housing portions 1 and 2 are respectively designed approximately trough-like, whereby the sidewalls 3 of the lower portion 2 are embraced by the sidewalls 4 of the upper portion 1 in a region of the sidewalls of the upper portion in which the sidewalls 4 of the upper portion exhibit a lesser thickness.

Figure 2:
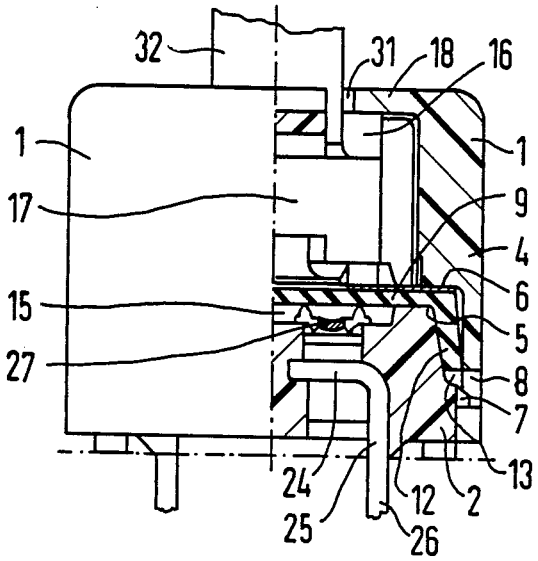
FIG. 2 is an end view, partially in section, of the switch illustrated in FIG. 1.

The end faces 5 of the sidewalls 3 thereby reside opposite a graduation or shoulder 6 of the sidewalls 4 of the upper portion 1 when the upper portion 1 is connected to the lower portion 2, for example by way of engaging projections 7 (FIG. 2) provided at the lower portion in windows 8 therefor provided in the upper portion.

A membrane 9 comprising an elastically-deformable material, and the edge 10 of the intermediate sheet 11, are pinched between the shoulder 6 of the upper portion and the end face 5 of the sidewalls 3 of the lower portion. An all around, angled-down portion 12 of the membrane 9 thereby engages into a gap 13 which tapers edge-like and which is provided between the sidewalls 3 of the lower portion 2 and the sidewalls 4 of the upper portion, being provided at right angles to the extent of these walls in an overlap region of the walls.

By so doing, the membrane 9 spans a space formed by a floor 14 and the sidewalls 3 of the lower portion 2 enclosing such space from the exterior.

This defined contact chamber 15 closed by the membrane 9 contains the movable and fixed contacts of the switch.

At the side of the membrane 9 facing away from the contact chamber 15, the membrane 9 limits an actuation chamber 16 formed by the walls of the upper portion 1 and an approximately block-shaped actuation member 17 comprising a plastic material can be transitionally moved back and forth in the actuating chamber 16 parallel to the membrane 9 between limit positions that are defined by the sidewalls 4 of the upper portion 1 which lie opposite one another.

The actuating member 17 is thereby supported (FIG. 2) against a wall 18 of the upper portion 1 which lies opposite the membrane 9 on the side of the actuating member 17.

The intermediate sheet 11, whose edge 10 is pinched between the upper portion 1 and the lower portion 2 together with the membrane 9 is located between the actuating member 17 and the membrane 9.

Figure 3:
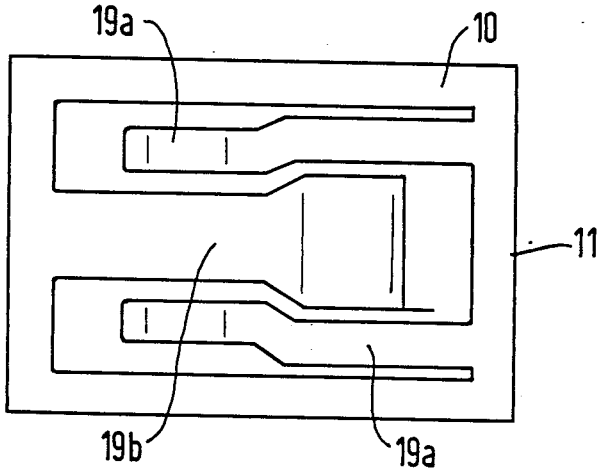
FIG. 3 is a top plan view of an intermediate sheet employed in the switch of FIGS. 1 and 2.

As particularly illustrated in FIG. 3, three tongues 19 are cut free from the intermediate sheet 11, two outer tongues 19*a* thereof being identically designed with their distal, free ends extending in the same direction. A middle tongue 19*b* is provided between and opposed in direction to the outer tongues 19*a*.

As particularly illustrated in FIG. 1, the tongues 19*a* and 19*b* are bent approximately S-shaped, namely such that a convex side of a first S-bend 20 provided at the free end of the tongues presses against the membrane 9. Each tongue 19 is supported against the actuating member 17 with the other S-curve 21.

Actuation ribs 23, extending in the actuation direction of the actuating member 17, protrude from that side of the actuating member 17 lying opposite and facing the membrane 9 and parallel thereto. An actuation rib 23 is assigned to each tongue 19. Each actuation rib 23 thereby begins about in the middle of the actuating member with an approach incline and then extends up to the end of the actuating member 17. The actuation rib 23 assigned to the middle tongue 19*b* is thereby provided at the one side of the actuating member 17 in the actuation direction of the actuating member 17, whereas the other two actuation ribs 23 are located at the other side of the actuating member.

The above-described structure provides that the two outer tongues 19*a* are supported against their assigned actuation ribs 23 in the one limit position, whereas the middle tongue 19*b* contacts the actuating member 17 at its side 22 outside of the assigned actuation rib 23 in this position of the actuating member 17. In this position of the actuating member 17 (as illustrated in FIG. 1), consequently, the two outer tongues 19*a* have their free ends pressed more strongly against the membrane 9 and therefore move the same towards the floor 14 of the lower portion 2 in this contacting region between the membrane 9 and the tongue 19*a*.

In the other limit position of the actuating member 17, by contrast, the free end of the middle tongue 19*b* is pressed downwardly and the membrane 9 is moved towards the floor 14 of the lower portion 2 in the contacting region between the tongue 19*b* and the membrane 9, whereas the two outer tongues 19*a* have their free ends located about in the plane of the edge 10 of the intermediate sheet 11 in this position of the actuating member 17, i.e. do not exert any noteworthy pressure against the membrane 9.

Two groups of fixed contacts are provided in the contact chamber 15, these being formed by the angled sections 24 of the wire pieces 25 that are bent L-shaped. The other L-arm of these wire-pieces 25 projects out of the switch housing at right angles relative to the floor 14 of the lower portion 2 as terminal elements 26 and can, for example, be soldered into grid bores of a printed circuitboard 40.

Each of the two groups of fixed contacts comprises respectively three L-sections 24 which are disposed at a specific distance from one another in the actuation direction of the actuating member 17 and respectively aligned with a corresponding fixed contact of the other contact group.

A center fixed contact 24*a* is disposed at a shorter distance from the membrane 9 than the two outer fixed contacts 24*b* of each contact group.

The center fixed contact 24*a* of each contact group serves as a pivot bearing for a respective contact bridge 27 that is designed like a balance beam and one of whose free ends 28 electrically connects one of the outer fixed contacts 24*b* to the center fixed contact 24*a* in its one limit position when it swings about the center fixed contact 24*a* and respectively connects the other of the outer fixed contacts 24*b* to the center fixed contact 24*a* in its outer limit position.

Each of the two contact bridges 27, which is respectively assigned to one of the two contact groups, comprises an offset bend 29 directed towards the membrane 9 between its free ends 28 and the center fixed contact 24*a*, the offset bend being located where an S-curve provided at the free end of a tongue 19 contacts the membrane 9.

In this manner, the outer tongues 19*a* move a contact bridge 27 into its one limit position when the actuating member 17 is located in its one limit position and the middle tongue 19*b* moves the contact bridge 27 into the other limit position when the actuating member 17 assumes its other limit position.

In the middle position of the actuating member 17, by contrast, the approximately planarly-extending membrane 9 prevents one of the free ends 28 of the contact bridges 27 from contacting an outer fixed contact 24*b*, since each contact bridge 27 strikes the membrane 9 with one of the offset bends 29 in this case before it reaches a limit position.

As illustrated in FIG. 3, the middle tongue 19*b* is broader at its free, distal end such that it can act on both contact bridges at the same time, whereas each of the outer tongues 19*a* only actuates respectively one of the two contact bridges.

The tongues 19 maintain the actuating member 17 pressed against the wall 18 of the upper portion 1 in each of its positions.

A center strip of the wall 18 which extends in the movement direction of the actuating member 17 comprises resilient wall portions 30 which are cut free so that they are connected only at their attached sides to the sidewalls 4 of the upper portion 1 so that they limit the motional play of the actuating member 17.

The free ends of the wall portions 30 therebetween form a passage 31 for a purchase 32 (switch handle) of the actuating member 17 which projects from the housing 1, 2 and comprise a respective hump 33 each at their respective sides facing the actuating chamber 16.

At its side facing away from the membrane 9, the actuating member 17 is likewise provided with two humps 34.

As illustrated in FIG. 1, a respective hump 34 engages behind a hump 33 when the actuating member is located in one of its limit positions. As a result thereof, the actuating member 17 is retained in each of these limit positions with an adequate latch-in action.

The humps 34 on the actuating element 17 lie at such a distance from one another in the actuating direction of the actuating member 17 that their sides mutually facing away from one another respectively contact one of the humps 33 of the wall portions 30 at their mutually-facing side when the actuating member 17 is located in the middle position. In this manner, the humps 33, 34 provide for locking in the limit positions are also advantageously employed for producing a locking effect in the middle position of the actuating member 17 in which the contact bridges are respectively lifted off from both of the outer fixed contacts 24*b*.

A sliding switch that can selectively connect a pair of fixed contacts to respectively one of two further fixed contacts is thereby realized. A switch position in which these connections are interrupted is also possible with this switch. Given such a switch, the contact chamber which contains the movable and fixed contacts is also reliably sealed against harmful environmental influences at the same time.

Although I have described my invention by reference to a particular illustrative embodiment, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A switch comprising:

a housing including a top, sidewalls and a floor;

an elastically-deformable membrane mounted in and dividing said housing into first and second chambers;

fixed contacts and movable contacts in said first chamber;

a slide switch actuator movably mounted in said second chamber for movement between first and second limits, respectively;

an intermediate sheet in said second chamber between said actuator and said membrane, said intermediate sheet comprising first, second and third tongues, each of said tongues comprising a first bent section engaging said membrane and a second bent section engaging said actuator;

said third tongue extending opposite said first and second tongues with respect to the directions of actuator movement;

said actuator on a surface facing the intermediate sheet having first, second and third profiles, said profiles being positioned so that with the actuator at the first limit, the first and second tongues are engaged by the first and second profiles as the third profile is disengaged from the third tongue and with the actuator at the second limit, the third profile engages the third tongue and the first and second profiles are disengaged from the first and second tongues;

said actuator comprising first and second humps spaced apart on its side opposite said top of said housing; and said housing comprising first and second resilient cantilevers extending towards one another in said second chamber and respectively comprising third and fourth humps at their ends which are respectively located in a yieldable interference relationship with said first and second humps for releasable lock-in at the first and second limits.

2. The switch of claim 1, wherein:

said top includes a slot therein comprising ends defined by said ends of said cantilevers carrying said third and fourth humps; and said actuator includes a handle extending through said slot.

3. A switch comprising: a housing including a top, sidewalls and floor; an elastically-deformable membrane mounted in the housing and dividing the housing into first and second chambers; fixed contacts and movable contacts being positioned in said first chamber; a slide switch actuator being movably mounted in said second chamber for movement between first and second limits, respectively, said actuator having a surface facing toward said membrane with first, second and third profiles and a top surface, said first and second profiles being adjacent one end of the actuator and the third profile being adjacent the opposite edge; an intermediate sheet in said second chamber between said actuator and said membrane, said intermediate sheet comprising first, second and third tongues, each of said tongues having a first bent section engaging said membrane and a second bent section for engaging a profile of the actuator, said first and second tongues extending in one direction and the third tongue extending in the opposite direction so that with the actuator at a first limit, the first and second profiles are engaging the second bent sections of the first and second tongues and the third profile is disengaged from the second bent portion of the third tongue and with the actuator at the second limit, said third profile engages the second bent portion of the third tongue and the first and second profiles are disengaged from the second bent portions of the first and second tongues; said actuator having first and second humps spaced apart on said top surface; and said housing having first and second resilient cantilevered levers extending towards one another in said second chamber and, respectively, comprising third and fourth humps at their ends, which are respectively located in a yieldable interference relationship with said first and second humps for releasably locking the actuator at the first and second limits.

4. A switch according to claim 3, wherein the third tongue extends between the first and second tongues.

5. A switch according to claim 3, which includes three fixed contacts with a first fixed contact positioned between the second and third contacts and the movable contact being engaged on the first contact and being shifted alternately into engagement with the second and third contacts as the position of the actuator is shifted between the first and second limits.

6. A switch according to claim 3, wherein the actuator on said top surface has an outwardly extending handle and said top of the housing coacts with the first and second resilient cantilevered levers to form a slot for receiving said handle.

* * * * *